US005157808A

United States Patent [19]

Sterner, Jr.

[11] Patent Number: 5,157,808

[45] Date of Patent: Oct. 27, 1992

[54] COIL SPRING COUNTERBALANCE HARDWARE ASSEMBLY AND CONNECTION METHOD THEREFOR

[75] Inventor: Maurice E. Sterner, Jr., Spring Grove, Pa.

[73] Assignee: Product Design & Development, Inc., York, Pa.

[21] Appl. No.: 836,565

[22] Filed: Feb. 18, 1992

[51] Int. Cl.[5] ..... E05D 13/00

[52] U.S. Cl. ..... 16/197; 267/156; 49/445

[58] Field of Search ..... 16/197, 77, DIG. 16, 16/DIG. 36; 267/156; 49/445, 446

[56] References Cited

U.S. PATENT DOCUMENTS

| | | | |
|---|---|---|---|
| 2,732,594 | 1/1956 | Adams et al. | 16/197 |
| 2,817,872 | 12/1957 | Foster | 16/197 |
| 3,150,420 | 9/1964 | Brenner . | |
| 3,452,480 | 7/1969 | Foster . | |
| 3,475,865 | 11/1969 | Arnes | 16/197 |
| 4,227,345 | 10/1980 | Durham, Jr. . | |
| 4,935,987 | 6/1990 | Sterner, Jr. . | |

*Primary Examiner*—John Sipos
*Assistant Examiner*—Carmine Cudo
*Attorney, Agent, or Firm*—Samuel M. Learned, Jr.

[57] ABSTRACT

An improved coil spring counterbalance assembly embodying a coil spring support structure that provides a cooperatively radiused restraining shoe against which the uninterrupted smooth external circumferential surface of the coil spring ribbon rotationally operates in extension and retraction thereof during counterbalanced sash movement, thereby eliminating both the clicking sound and spring rotational cyclic vibrational shocks otherwise caused by the spring interior ribbon core tail ending riding over the top of a spring core support hub, in addition to a multiple coil spring connection method for improved successive affixment of extended coil spring ribbons one to the other and in turn to the sash attached balance shoe connector therefor when more than on coil spring is required in order to effect proper sash counterbalancing.

3 Claims, 5 Drawing Sheets

COIL SPRING COUNTERBALANCE HARDWARE ASSEMBLY AND CONNECTION METHOD THEREFOR

BACKGROUND OF THE INVENTION

The present invention relates to an improved coil spring counterbalance assembly for use on vertically sliding window sashes wherein the improved assembly hereof incorporates structural embodiments which substantially enhance the smoothness of counterbalance sash operation as well as the ease and facility with which one may install and connect multiple spring components one to the other and to the sash attached balance shoe connector when more than one spring component is required in order to adequately counterbalance a particular sash.

As shown in Applicant's previous teaching, in U.S. Pat. No. 4,935,987 dated Jun. 26, 1990, to Sterner, and in particular as illustrated in FIGS. 2, 3 and 4 thereof, the respective counterbalance springs are each supported by a hub insertably installed through the core openings thereof, upon which hub a coil spring rotates in feeding out and retracting the coil ribbon thereof during vertical movement of a sash in opening and closing operations. Each of the coil spring ribbons has a ribbon core tail ending that in consequence cyclically snaps over the support hub in radius adjustment as the coil spring radius decreases or increases upon sash movement whereby the coil spring radius snapping adjustment effect in turn causes both a distinct and audibly distracting sound in addition to any annoying sash vibration, which sound and vibration effects become more pronounced with the use of multiple coil springs to balance a sash. The counterbalance coil spring sub-assembly as taught in U.S. Pat. No. 4,227,345 to Durham, Jr., dated Oct. 14, 1980, and best illustrated in FIG. 5 thereof, shows a structure in some respects similar to that herein taught but is distinguished in that the coil spring of Durham, Jr., is attached to and supported by the mounting bracket hub thereof.

Other coil spring sash balance hardware apparatus provide for coil support about the external circumferential surface of the spring, such as those respectively taught in U.S. Pat. No. 3,150,420 to Brenner, dated Sept. 29, 1964, and U.S. Pat. No. 3,452,480 to Foster, dated Jul. 1, 1969.

Prior art coil spring counterbalance devices of the external circumferential support category do avoid the snapping sound and sash vibration effects, but do not adapt well to use in applications requiring multiple springs for the counterbalancing of heavier sashes.

The applicant's improved coil spring counterbalance assembly, however, mechanically provides a structural capability to both enhance the ease and smoothness of sash operation as well as at the same time providing a connection method for joining successive coil spring ribbons in sash counterbalancing applications requiring a use of multiple coil springs, all in a manner as hereinafter more fully detailed and described.

SUMMARY OF THE INVENTION

It is the principal object of the present invention to provide an improved coil spring counterbalance hardware assembly which operates by means of a coil spring ribbon that extends and retracts about the uninterrupted external coil circumferential surface thereof compressively against a cooperatively radiused restraining shoe to thereby enhance the smoothness of sash raising and lowering by eliminating both the clicking sound and spring rotational cyclic vibrational shocks otherwise caused by the spring component interior ribbon core tail ending riding over the top of a spring core support hub as is characteristically common of prior art coil spring counterbalance assemblies.

It is another object of the present invention to provide an improved spring ribbon connection method for affixing an extended coil spring ribbon to the sash attached balance shoe connector therefor, or in the event of multiple coil spring assembly employment, an improved method for affixing the extended coil spring ribbons one to the other successively to the lead coil spring ribbon which is in turn affixed to the sash attached balance shoe connector therefor.

A further object of the present invention is to provide an improved counterbalance hardware assembly which is adapted to cooperatively accommodate the addition of individual coil spring elements as may be necessary to achieve the proper counterbalance effect for the weight of a particular sash to be supported.

It is also an object of the present invention to provide an improved coil spring counterbalance hardware assembly spring ribbon connection slot structure which facilitates the ease and convenience of affixing multiple coil springs to connect one with the other and to the sash attached balance shoe connector.

It is a further object of the present invention to provide an improved coil spring counterbalance hardware assembly spring ribbon connection method which optimizes the effective range of multiple coil spring utility and efficiency in providing a substantially constantaly uniform counterbalance force effect throughout the raising and lowering limits of any particular sash to which said assembly is affixed in achieving the counterbalance thereof.

Still another object of the present invention is to provide an improved coil spring counterbalance hardware assembly adapted to be installably utilized within both the conventional modern and traditional older sash and jamb structures as either a retrofit or replacement sash counterbalance means, without the costly need or necessity to re-design or reconstruct either the sash or supporting jamb and frame structures therefor.

Yet another object of the present invention is to provide an improved coil spring counterbalance hardware assembly which when operationally installed is hidden from view, and is yet easily accessible for maintenance, repair, or removal as may from time to time be necessary.

It is an additional object of the present invention to provide an improved coil spring counterbalance hardware assembly which is efficient in design, economical in cost, and easy to install and maintain.

The foregoing, and other objects hereof, will be readily evident upon a study of the following specification and accompanying drawings comprising a part thereof.

DETAILED DESCRIPTION OF THE INVENTION

Figure 1:
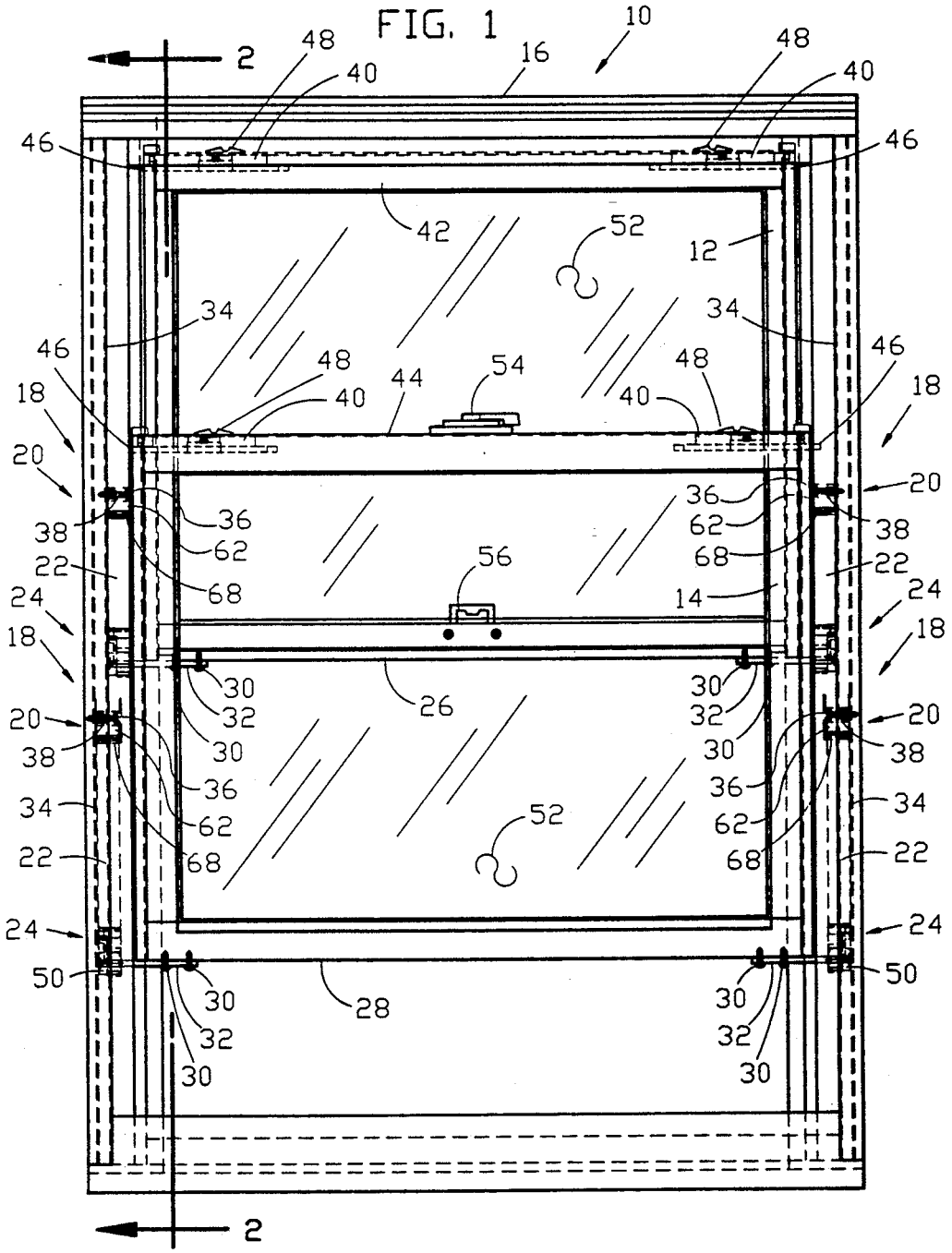
FIG. 1 is a front elevation view of a typical double hung window embodying upper and lower vertically sliding sash members, therein showing an exemplary installation of improved coil spring counterbalance hardware assemblies comprising the instant invention.

Referring to FIG. 1, a front elevation view of a typical double hung window 10 embodying an exemplary set of upper and lower vertically sliding sash members, comprised of an upper sash 12 and a lower sash 14 both of which sashes are cooperatively installed within and supported by a typical window frame encasement structure 16, said sashes 12 and 14 being respectively shown counterbalance by a spaced set of the improved coil spring counterbalance hardware assemblies 18 of instant invention which are illustrated and installed in a manner typical of that for either an original equippage or retrofit application. It should be noted, however, as would be determined by the size and weight of a sash to be counterbalanced in each particular use circumstance, as well as the counterbalance coil spring force rating of an individual coil spring sub-assembly 20, there may be a requirement to employ multiple numbers of the individual coil spring sub-assemblies 20 of said hardware assembly 18 joined by the respective coil spring ribbons 22 thereof in successive coil spring connection one to the other and to the sash attached balance shoe connector 24 therefor by the method as hereinafter taught by illustration and description. Thus, each improved coil spring counterbalance hardware assembly 18 is comprised of at least one individual coil spring sub-assembly 20 connected by means of the coil spring ribbon 22 thereof to a sash attached balance shoe connector sub-assembly 24.

Reffering again to FIG. 1 to discuss general considerations of the method for installing the improved coil spring counterbalance hardware assemblies 18, wherein it will be noted for purposes of obtaining optimum sash 12 and 14 operational balance within the frame encasement structure 16 an installation of said hardware assemblies 18 is preferably comprised of a spaced set thereof for each sash 12 and 14 to thereby minimize any tendency for a sash to cant or cock and thereby bind within the encasement structure sash guide tracks during sash raising or lowering operations. Installation of said hardware assemblies 18 is simply and efficiently accomplished by first affixing a balance shoe connector sub-assembly 24 to either lateral lower side of the upper and lower sash 12 and 14 respective lower sash frame members 26 and 28 by means of a set of connector bracket screws 30 insertable installed through openings therefor in the balance shoe connector bracket 32 and threadably secured into the opposingly spaced outer lateral underside surfaces of said lower sash frame members 26 and 28, wherein it should be noted, regardless of the number of individual coil spring sub-assemblies 20 to be employed in achieving proper sash 12 and 14 counterbalancing, whether it be either single or successive such coil spring sub-assemblies 20, only one sash attached balance shoe connector sub-assembly 24 is required.

Next, at a vertical position above each of the respective lower sash frame members 26 and 28 when the corresponding upper and lower sashes 12 and 14 therefor are in the closed position, either a single or successively stacked individual coil spring sub-assemblies 20 are securably installed to the corresponding window jamb 34 by means of insertable threadable connection of a spring bracket screw 36 through an opening in the spring bracket cap spacing post 38 and to said corresponding window jamb 34.

As also shown in FIG. 1, the respective sashes 12 and 14 are adapted to be pivotally opened inward and are therefore each provided with a set of spring loaded jamb latches 40 assembled to the upper sash frame member 42 and the lower sash upper frame member 44, which jamb latches 40 function to retain the respective sashes 12 and 14 within the encasement structure sash guide tracks respectively by means of engagement of the jamb latch lugs 46 of said latches 40 within said guide tracks for normal vertically slidable displacement of said sashes 12 and 14 within said encasement structure guide tracks. Upon manual retraction of a set of the jamb latch lugs 46 for either sash 12 or 14, by means of simultaneous sash inward displacement of the jamb latch push pads 48, said lugs 46 are thereby retracted from the subject guide tracks and the sash 12 or 14 as the case may be is then pivotally rotated inwardly about the rotation hub 50 of the sash attached balance shoe sub-assembly for purposes of window pane 52 cleaning or the like. Afterwards the pivotally opened sash may be returned and secured in a normally vertical position within the window frame encasement structure 16 simply by means of reverse rotation thereof about the rotation hub 50 and re-engagement of the latch lugs 46 within the encasement structure guide tracks. Additionally, the window 10 is provided with a locking means typically consisting of a cam latch assembly 54 which is installed upon the upper mid-point surface of the lower sash upper frame member 44, which cam latch assembly 54 is cooperatively operable pivotally to lockably and releasably engage a cam latch retainer 56 which is assembled to the upper mid-point of the upper sash lower frame member 26.

At this point it should be noted that although the sash attached balance shoe connector sub-assembly 24 is shown and illustrated in a typical tilt window hardware component profile, this is exemplary only and the sash attached balance shoe connector sub-assembly 24 could just as well be provided in a standard non-tilt window hardware component profile with equally beneficial and satisfactory results.

Figure 2:
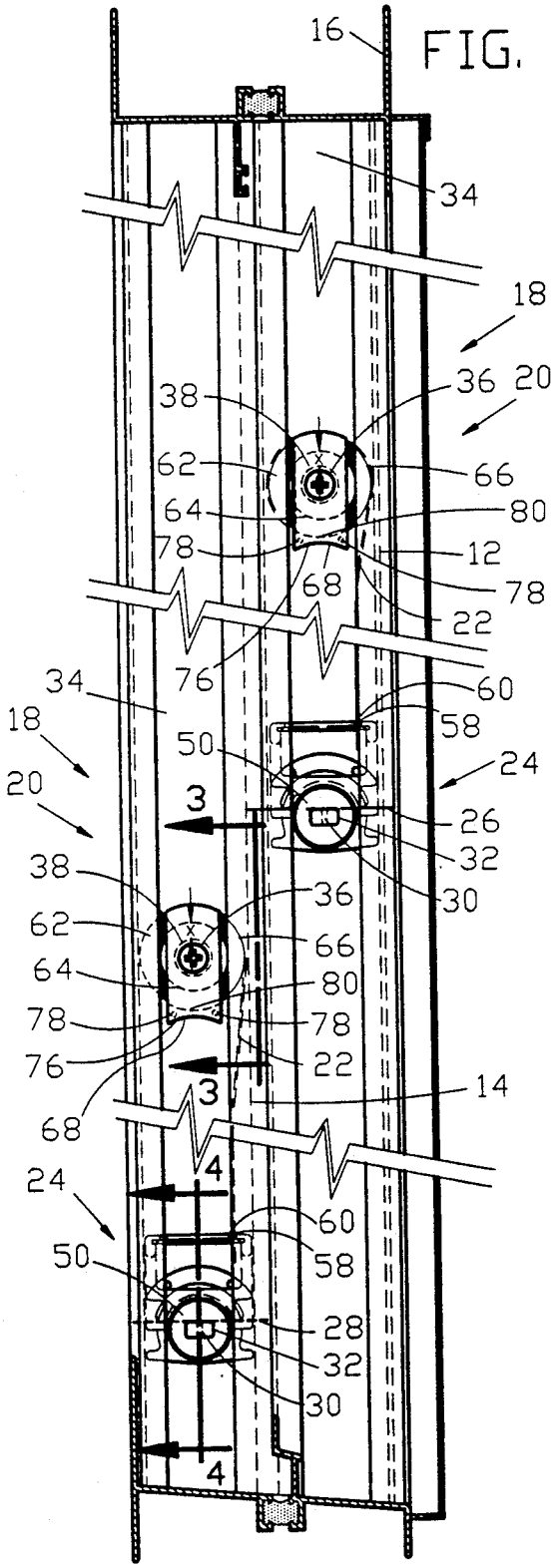
FIG. 2 is an enlarged foreshortened side elevation view of the improved coil spring counterbalance hardware assemblies as taken along the line 2—2 of FIG. 1.
Figure 3:
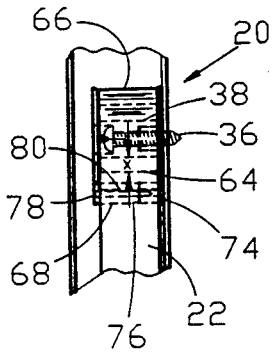
FIG. 3 is a front elevation view of the coil spring sub-assembly component of the instant invention as seen along the line 3—3 of FIG. 2.

Considering now FIG. 2, which shows greater structural detail of the improved coil spring counterbalance hardware assembly 18 and the coil spring 20 and balance shoe connector 24 sub-assembly components thereof. Particularly shown is connection of the coil spring ribbon 22 by means of the ribbon tail slot 58 in cooperative engagement within the balance shoe connector coil spring ribbon receiving slot 60, which is also illustrated in corresponding FIG. 4. Additionally shown in FIG. 2 as well as in corresponding FIG. 3 is the coil spring 62 interior ribbon core 64 circumferential clearance "X" with respect to the outer circumference of the spring bracket cap spacing post 38, and the uninterrupted external coil spring circumferential surface 66 support by the cooperatively radiused coil spring restraining shoe 68 whereby low noise level and non-vibrational coil spring 62 extension and retraction is achieved upon sash 12 or 14 vertical displacement. It will be noted, as best shown in FIG. 3, the cooperatively radiused coil spring restraining shoe 68 is a sectional piece so as to facilitate coil spring 62 assembly within the coil spring sub-assembly 20 as will hereinafter be more fully explained, wherein one sectioned piece of said radiused coil spring restraining shoe 68 is a shoe base 74 which is registerably interconnected to a shoe base cover 76 by means of register connecting pins 78 whereby a smooth cooperative radiused coil spring support surface 80 is provided against which the uninterrupted external coil spring circumferential surface 66 smoothly operates in extension and retraction of the coil spring 62 upon vertical displacement of a sash 12 or 14.

Figure 4:
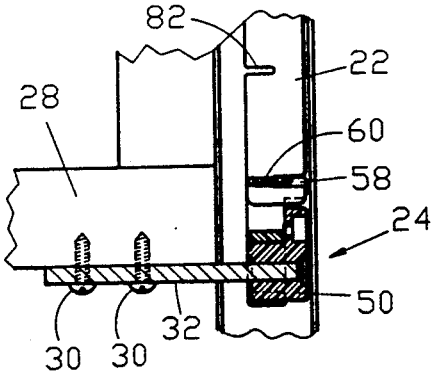
FIG. 4 is a front elevation view of the balance shoe sash connector sub-assembly component of the instant invention as seen along the line 4—4 of FIG. 2.

Referring now to FIG. 4, wherein is shown greater sectional detail of assembly of the sash attached balance shoe connector sub-assembly 24 to the lower sash lower frame member 28 by means of threadable connection therewith of connector bracket screws 30 through openings in the balance shoe connector bracket 32. Also shown as previously described is interconnected assembly of the coil spring ribbon 22 by means of the coil spring ribbon tail slot 58 insertably within the balance shoe connector coil spring ribbon receiving slot 60 whereby the coil spring sub-assembly 20 of the hardware assembly 18 is made operationally functional with the balance shoe connector sub-assembly 24 thereof in providing low noise level vibration free counterbalancing of a sash 12 or 14 on vertical displacement thereof within the window frame encasement structure 16. Additionally shown in FIG. 4 is the coil spring ribbon interconnecting slot 82 which is employed for assembling coil spring ribbons 22 to each other and to the balance shoe connector sub-assembly 24 when it is necessary to employ an in-series plurality of individual coil spring sub-assemblies 20 in achieving proper sash 12 or 14 operational counterbalance within the window frame encasement structure 16.

Figure 5:
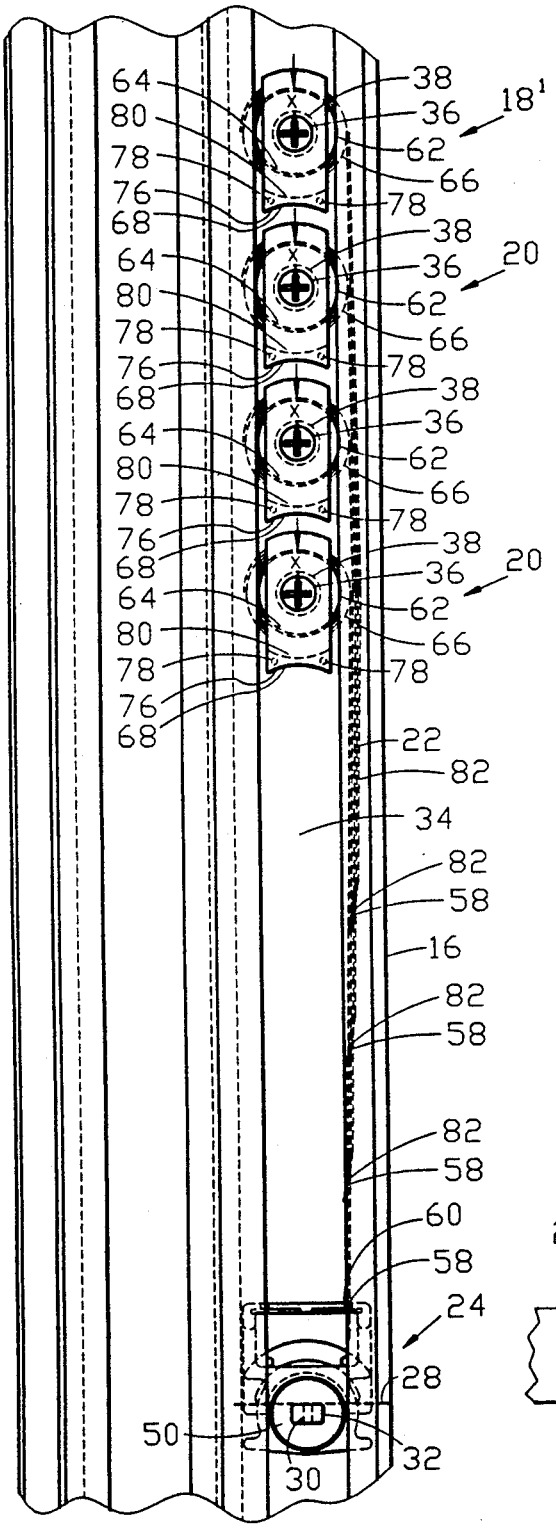
FIG. 5 is a partial side elevation view of a typical heavy duty window frame and sash assembly showing an exemplary installation therein of an improved coil spring counter balance hardware assembly embodying the employment of successively connected multiple coil spring sub-assembly components to thereby accommodate counterbalancing of a heavier sash.
Figure 6:
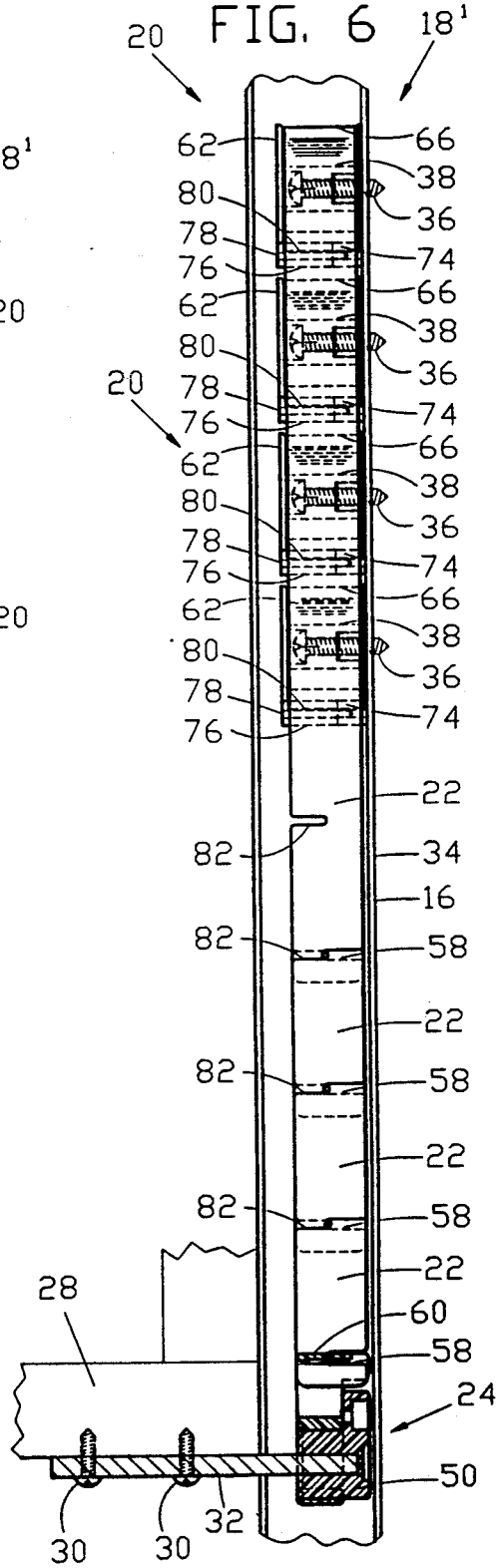
FIG. 6 is an front elevation view of the typical heavy duty window frame and sash assembly and exemplary hardware installation as shown in FIG. 5.

Turning now to a consideration of FIGS. 5 and 6 to explain in greater detail the assembly method for interconnecting an in-series plurality of individual coil spring sub-assemblies 20 in achieving heavy or large size sash 12 or 14 operational counterbalance, wherein it is to be understood that the specific number of individual coil spring sub-assemblies 20 that may be required is determined by the coil spring 62 force ratings in relation to the sash 12 or 14 weight to be counterbalanced, and the illustration in FIGS. 5 and 6 of four such coil springs 62 is to be regarded as exemplary only for purposes of explaining the connection method.

Referring to FIGS. 5 and 6, an improved coil spring counterbalance hardware assembly 18 embodying a plurality of coil spring sub-assemblies 20 is shown, which sub-assemblies 20 are installed respectively by means of spring bracket screw 36 threadable connection to the window jamb 34 as was previously described for installation of a single such sub-assembly 20, in series, so that the respective coil spring ribbons 22 thereof may be drawn down and cumulatively assembled one to the other by successive coil spring ribbon tail slot 58 interconnection to coil spring ribbon interconnecting slot 82. The assembly sequence as aforesaid being first an interconnection of the coil spring ribbon tail slot 58 of the lowermost coil spring 62 with the balance shoe connector coil spring ribbon receiving slot 60, followed by interconnection of the coil spring ribbon tail slot 58 of the next most lowest coil spring 62 of said plurality with the coil spring ribbon interconnecting slot 82 of the lowermost coil spring 62 thereof, and thereafter progressively upward in a similar such successive coil spring 62 tail slot 58 to interconnecting slot 82 assemblage pattern. Such a method of successive in-series coil spring 62 interconnection maximizes operational efficiency of the cumulative coil spring counterbalancing effect as well as easing the manual aspects of effecting coil spring interconnection since the amount of coil spring ribbon 22 that must be withdrawn to effect interconnection is minimal as compared to interconnecting each such separate coil spring ribbon 22 separately to the balance shoe connector sub-assembly 24 as is typically done in prior art hardware assemblies of the type herein dealt with and as more particularly shown in FIGS. 7 through 9 next to be considered.

Figure 7:
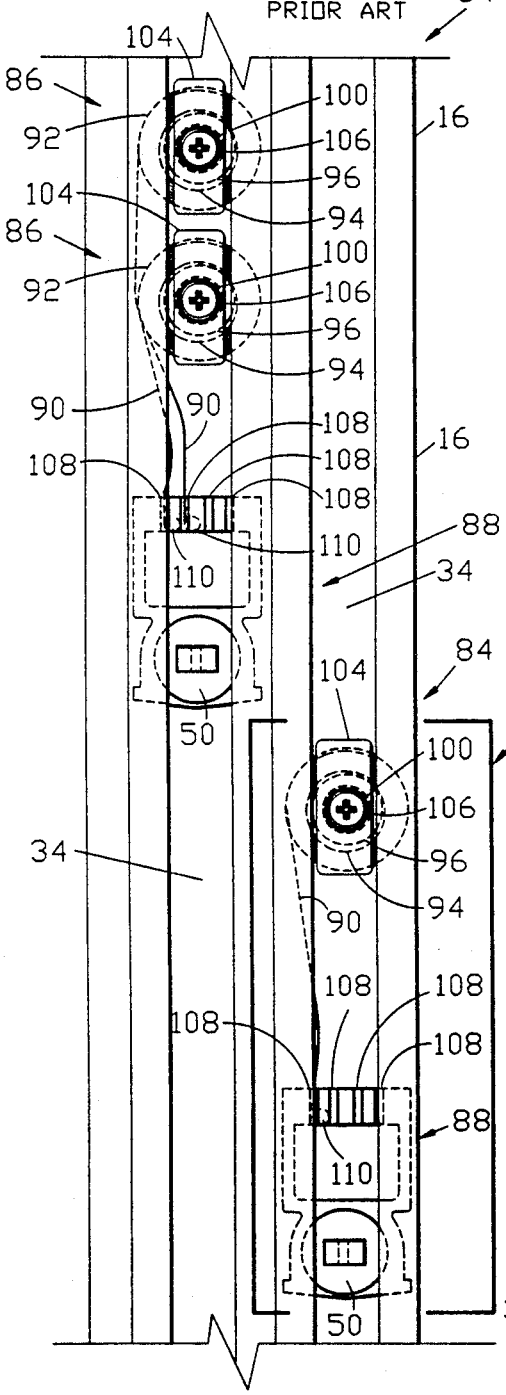
FIG. 7 is a partial side elevation view of a typical window frame and sash assembly showing installation therein of exemplary prior art multiple and single coil spring counterbalance hardware assemblies.

The exemplary prior art coil spring counterbalance hardware assembly 84 as illustrated in FIG. 7 shows upper sash counterbalancing with two coil spring assemblies 86, which are interconnected to the balance shoe component 88 in a manner typical of such prior art hardware assemblies 84 which is by individual spring ribbon 90 affixment thereto. With respect to the prior art lowermost coil spring assembly 86 spring ribbon 90 extension for connection to the balance shoe component 88 there is no appreciable difference between that and that of the present invention 18, whether a single or a plurality of coil spring assemblies 86 are involved. However, in the case of a plurality of coil spring assemblies 86 in series in successive interconnection to the balance shoe component 88, each subsequent spring ribbon 90 as shown must be correspondingly increased in extension to effect balance shoe 88 connection which incrementally decreases the overall counterbalance efficiency of a multiple springed hardware assembly 84 by successively increasing the respective spring ribbon 90 extensions and consequent pre-loads on the corresponding coil spring assemblies 86. Secondly, installation of such a prior art multiple springed hardware assembly 84 is more difficult since the spring ribbon 90 of each successively removed coil spring assembly 86 must in turn be successively increased in extension by a correponding amount in order to effect balance shoe 88 interconnection. Thus is the difference and distinction of methodology for coil spring to balance shoe interconnection between that of a typical prior art coil spring counterbalance hardware assembly 84 embodying the use of a successive plurality of coil springs in series and that of a corresponding improved coil spring conunterbalance hardware assembly 18 as previously illustrated and explained on the earlier consideration of FIGS. 5 and 6.

Figure 8:
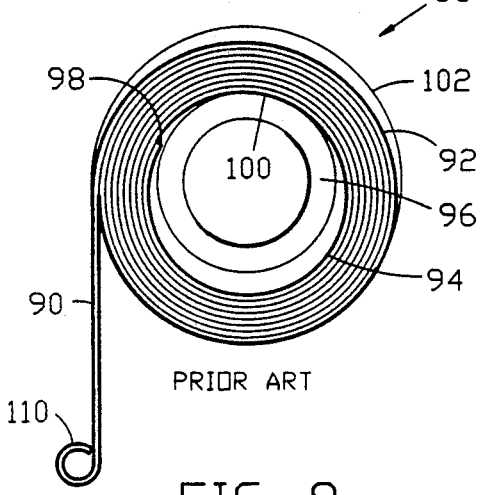
FIG. 8 is an enlarged side elevation view of an exemplary prior art coil spring counterbalance component therein showing the spring interior ribbon core tail ending to spring core support hub relationship.

The enlarged side elevation view illustration of FIG. 8 shows the manner of support provided for a prior art coil spring 92, which is the source for noise and vibration effects as previously mentioned and evidenced upon vertical displacement of a sash counterbalanced by a prior art coil spring hardware assembly 84. As shown, the coil spring 92 interior coil spring circumferential surface 94 is supported by and rotates upon the coil spring mounting bracket bushing 96 as the spring ribbon 90 is extended or retracted upon vertical displacement of a sash to which said coil spring 92 is interconnectedly assembled. As the coil spring 92 rotates upon the bushing 96, the interior circumferential coil spring tail ending 98 in rotationally riding over the bushing mid-point support surface arc 100 snaps thereagainst on each rotational cycle when the coil spring 92 radius automatically compensates for a change thereof upon spring ribbon 90 extension or retraction during attached sash vertical displacement. It is this coil spring 92 cyclical radius compensating snap effect which causes the annoying noise and sash vibration during vertical displacement thereof. Since in the instant invention, as previously explained, the uninterrupted external coil spring circumferential surface 66 is supported by and rotates upon the smooth cooperative radiused coil spring support surface 80 of the cooperatively radiused coil spring restraining shoe 68 during coil spring ribbon 22 extension or retraction upon sash attached vertical displacement, there is no cyclical radius compensating snap effect as otherwise described for the typical prior art coil spring counterbalance hardware assembly 84 and therefore no annoying clicking sound or sash vibrational effects are produced.

Figure 9:
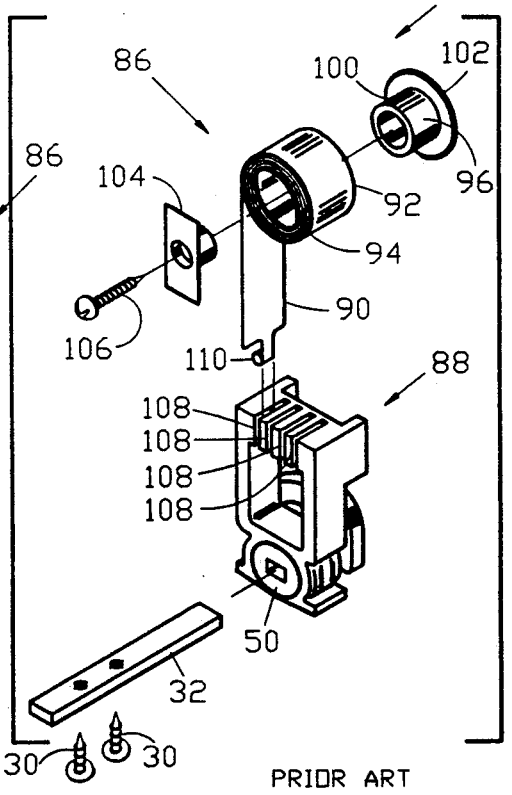
FIG. 9 is an exploded perspective view of an exemplary prior art coil spring counterbalance hardware assembly.

Directing attention now to FIG. 9, which is an exploded perspective view of the exemplary prior art coil spring counterbalance hardware assembly 84, therein showing the physical assembly relationships of the various component elements thereof, and particularly the coil spring 92 core opening insertion upon the mounting bracket bushing 96 for coil spring 92 supportable retention between the mounting bracket bushing collar 102 and the bushing cap collar 104 when the two are insertably joined and retained by the bracket screw 106 and installed in affixment to a window jamb 34 as previously shown in FIG. 7. Also shown is the manner of connectably assembling the spring ribbon 90 to the balance shoe component 88, which is by means of individual coil spring 92 spring ribbon 90 retainable insertion within one of the plurality of balance shoe spring ribbon connection slots 108 and stoppable retention therewithin by means of the spring ribbon loop 110. Mounting of the balance shoe component 88 to a lower sash frame member is as was before, with insertion of connector bracket screws 30 through openings in the balance shoe connector bracket 32 and then threadable assembly to the lower sash frame member.

Figure 11:
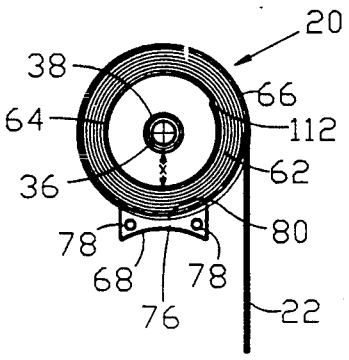
FIG. 11 is an enlarged side elevation view of the coil spring counterbalance component of instant invention therein showing the external coil ribbon diameter relationship to the cooperative radiused restraining shoe as well as the spring interior ribbon core tail ending clearance of the core support hub.
Figure 10:
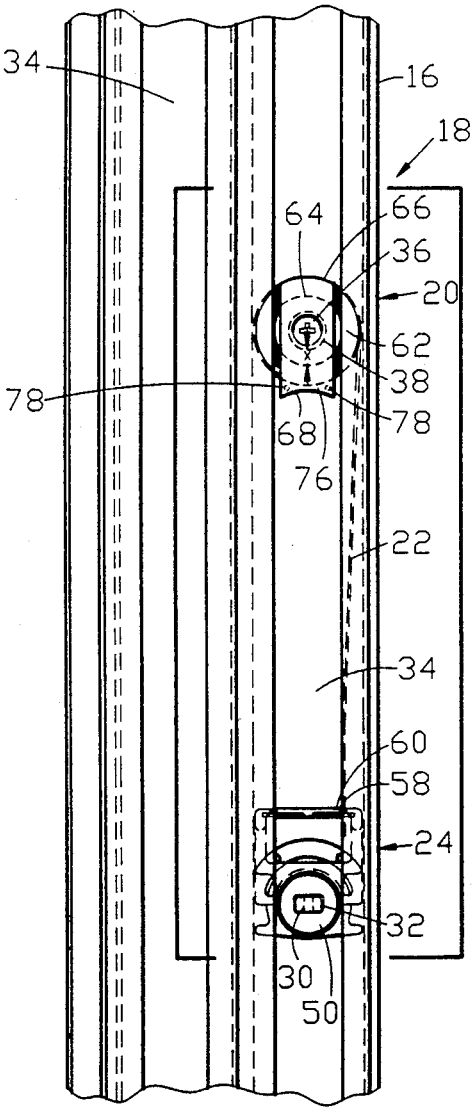
FIG. 10 is a partial side elevation view of a typical window frame and sash assembly showing installation therein of the improved coil spring counterbalance hardware assembly of instant invention.
Figure 12:
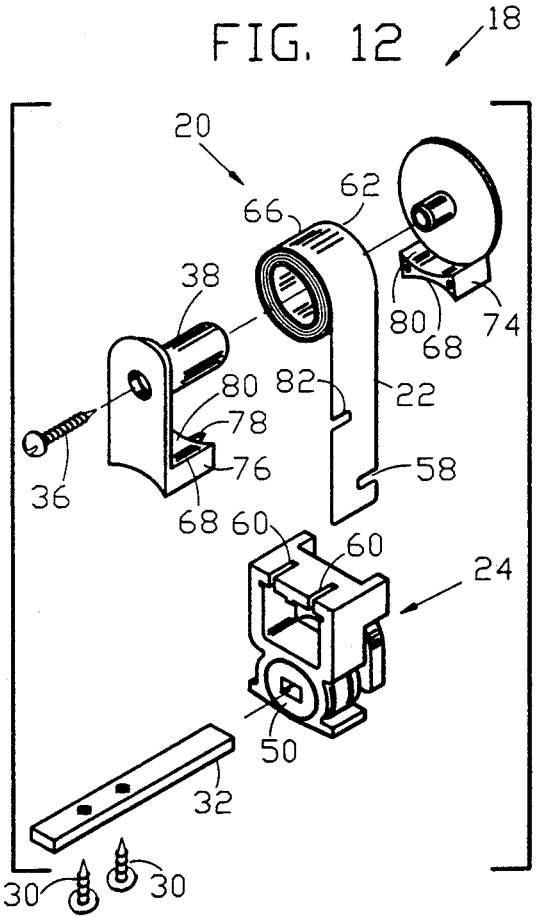
FIG. 12 is an exploded perspective view of the improved coil spring counterbalance hardware assembly of instant invention.

Considering lastly the series of improved coil spring counterbalance hardware assembly 18 views shown in FIGS. 10 through 12, wherein FIG. 10 depicts an exemplary hardware assembly 18 installation within a typical window frame encasement structure 16. The enlarged side elevation coil spring sub-assembly 20 view shown in FIG. 11 illustrates clearly the interior ribbon core cumferential clearance "X" between the coil spring interior ribbon core 64 and the spring bracket cap spacing post 38 so there is no operational contact of any hardware assembly 18 structure with the interior coil spring circumferential tail ending 112 whereby neither cyclical noise or vibrational effects are brought into play during vertical displacement movement of a sash. The exploded perspective hardware 18 assembly view shown in FIG. 12 illustrates how the various component parts thereof fit together, and the structural relationship of the uninterrupted external coil spring circumferential surface 66 to the supportable retention thereof by the smooth cooperative radiused coil spring support surface 80 whereby noise and vibration free operation is achieved.

Although the invention has been herein shown and described in what is conceived to be the most practical and preferred emdodiment and method, it is recognized that departures may be respectively made therefrom within the scopes thereof, which are not to be limited to the specific details disclosed herein but are to be accorded the full scope of the claims so as to embrace any and all equivalent improved coil spring counterbalance hardware assemblies and the connection methods therefor.

I claim:

1. An improved coil spring counterbalance hardware assembly adapted for counterbalancing a vertically displaceable sash within a window frame encasement structure, said assembly comprising in combination at least one coil spring sub-assembly having a coil spring supportably retained about the uninterrupted external coil spring circumferential surface thereof within said coil spring sub-assembly by means of a cooperatively radiused coil spring restraining shoe said coil spring sub-assembly being adapted for installation connection to a window jamb of said window frame encasement structure, a sash attached balance shoe connector sub-assembly adapted for installation connection to the lower frame member of said sash the same side thereof as the installation connection of said coil spring sub-assembly to said window jamb, and a coil spring ribbon of said coil spring of said coil spring sub-assembly extendable therefrom and connectable to a balance shoe slot within said balance shoe connector sub-assembly by means of a first cooperatively complementary slot means on one side edge of said coil spring ribbon and inward from the end thereof, wherein said coil spring is further provided with a second cooperatively complementary slot means on the opposite side edge of said coil spring ribbon as said first cooperatively complementary slot means and at a greater inward distance from the end than said first slot means.

2. The improved coil spring counterbalance hardware assembly according to claim 1 having a plurality of coil spring sub-assemblies connected to said window jamb in a sucessively removed cooperative in-series relation with respect to said sash attached balance shoe connector sub-assembly.

3. The improved coil spring counterbalance hardware assembly according to claim 2 wherein the respective coil spring ribbons of the respective coil springs of said plurality of coil spring sub-assemblies are connectably assembled one to the other in series and to said sash attached balance shoe connector sub-assembly by means of successive coil ribbon interconnection of the first cooperatively complementary slot means respectively therein with the second cooperatively complementary slot means respectively therein.

* * * * *